United States Patent [19]

Rudell et al.

[11] Patent Number: 4,991,847

[45] Date of Patent: Feb. 12, 1991

[54] TIMED WATER RELEASE TOY

[76] Inventors: Elliot Rudell, 6556 Sattes Dr., Rancho Palos Verdes, Calif. 90274; George Foster, 2700 Panorama Dr. #404, Signal Hill, Calif. 90806; Joseph Cernansky, 2369 W. 246th Pl., Lomita, Calif. 90717

[21] Appl. No.: 433,593

[22] Filed: Nov. 13, 1989

Related U.S. Application Data

[63] Continuation-in-part of Ser. No. 299,225, Jan. 23, 1989, Pat. No. 4,890,838.

[51] Int. Cl.[5] ..... A63F 9/100; A63B 71/00

[52] U.S. Cl. ..... 273/138 R; 273/1 GE; 273/58 H

[58] Field of Search ..... 273/1 R, 1 G, 1 GE, 273/58 B, 58 BA, 58 H, 138 R, 1 L, 118 R, 119 B; 446/267

[56] References Cited

U.S. PATENT DOCUMENTS

| | | | |
|---|---|---|---|
| 3,795,400 | 1/1974 | Glass et al. | 273/1 R |
| 4,212,460 | 7/1980 | Kraft | 446/267 |
| 4,783,074 | 11/1988 | Kobayashi | 273/157 R |
| 4,881,733 | 11/1989 | Rehkemper et al. | 273/1 R |
| 4,890,838 | 1/1990 | Rudell et al. | 273/138 R |

*Primary Examiner*—Edward M. Coven
*Assistant Examiner*—Sebastiano Passaniti
*Attorney, Agent, or Firm*—Plante, Strauss, Vanderburgh and Connors

[57] ABSTRACT

There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

14 Claims, 4 Drawing Sheets

FIG. 2
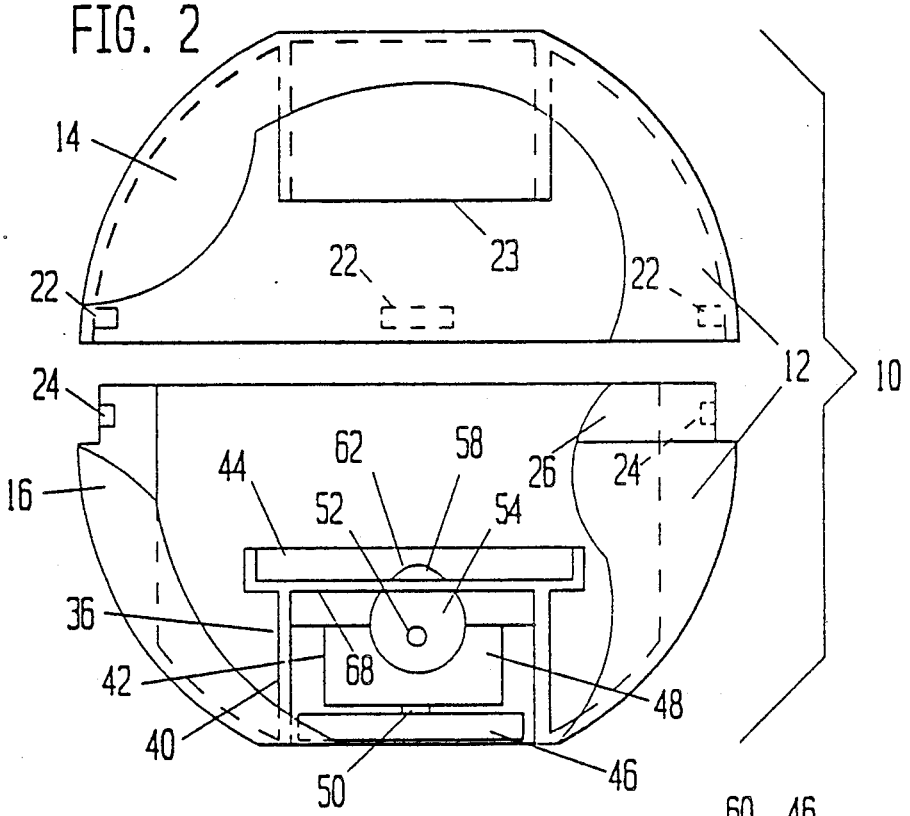
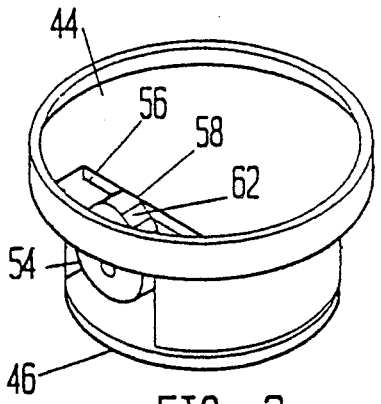
FIG. 3
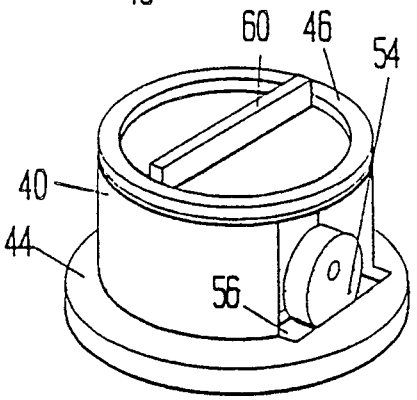
FIG. 4

FIG. 5
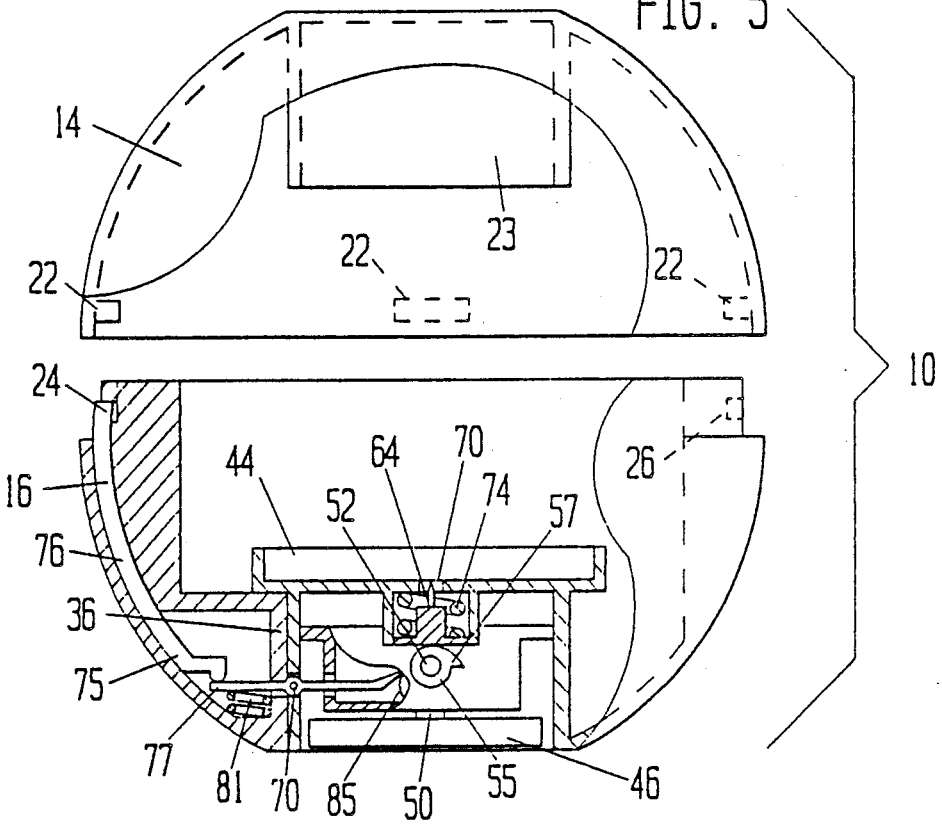
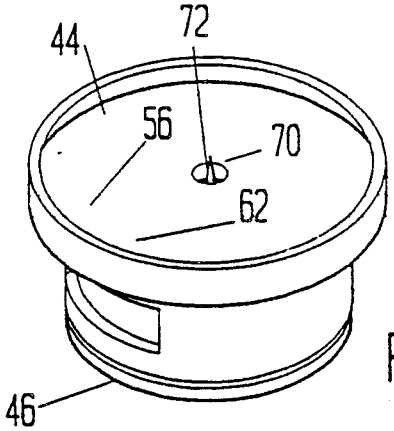
FIG. 6
FIG. 7
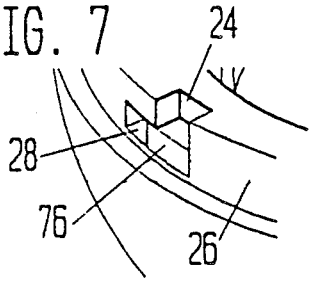

TIMED WATER RELEASE TOY

RELATED APPLICATIONS

This application is a continuation-in-part of our copending application, Ser. No. 07/299,225, filed on Jan. 23, 1989, now U.S. Pat. No. 4,890,838.

BACKGROUND OF THE INVENTION

1. Field of Invention

This invention relates to a ball and game, and in particular, to a game using the ball and to a timed water release mechanism.

2. Brief Statement of the Prior Art

Several different activity toys involving water play resulting in wetting of the players are currently on the market. One in particular is marketed by Mattel Toys and is called WETHEAD. This product involves a hat-like device that a player wears and comprises a water container on a hat having a release valve permitting the water to empty onto the wearer's head. Only one of eight removable rods releases the water valve. The other seven placebo rods are identical and the player wearing the hat must select and remove a rod. This toy does not involve timing, tossing, or ball play. The water containing element is a hat which is not disposable and is refilled and reused during the play. Other water products that have been offered to children include sprinkler based toys, such as WATER WIGGLER, and WET BANANA. These toys attach to a garden hose and provide a constant flowing film of water on a surface which children run or slide through. These toys do not provide an element of surprise or challenge.

Parker Brothers, a game manufacturer, is currently marketing a product called HOT POTATO. This consists of a cloth covered foam "potato" that young children toss back and forth between each other. Inside the potato is an electronic sound generating device that signals the end of the play session. The player holding the potato at the end of the session must take a card spelling part of the toy's name. This product does not involve water, is not a ball, and provides no action "penalty" such as a soaking of the player.

BRIEF STATEMENT OF THE INVENTION

This invention comprises a game which employs a water-filled ball, which has a water release mechanism and a timer that activates the water release mechanism on a preset, or randomly selected time interval, to discharge the water from the ball, wetting the player who is handling or catching the ball at the moment of release. For this purpose, the ball can have an inner membrane which forms an interior closure which is charged with water at commencement of play. The timer is activated and the ball is used in a game in which it is tossed between participants who seek to avoid becoming wet when the timer releases the water from the interior closure of the ball.

BRIEF DESCRIPTIONS OF THE DRAWINGS

The invention will be described with reference to the FIGURES of which:

FIG. 2 is an elevational view of the ball partially disassembled and in partial cross-section;

FIG. 3 is a perspective view of the timer and liquid release mechanism;

FIG. 4 is an inverted view of the timer and water release mechanism of the toy of FIG. 1;

FIG. 5 is an elevational view of an alternative toy of the invention partially disassembled and in partial cross-section;

FIG. 6 is a perspective view of the timer and water release mechanism of the toy of FIG. 5;

FIG. 7 is a perspective view of a safety interlock for the toy of FIG. 6;

DESCRIPTION OF PREFERRED EMBODIMENT

Figure 1:
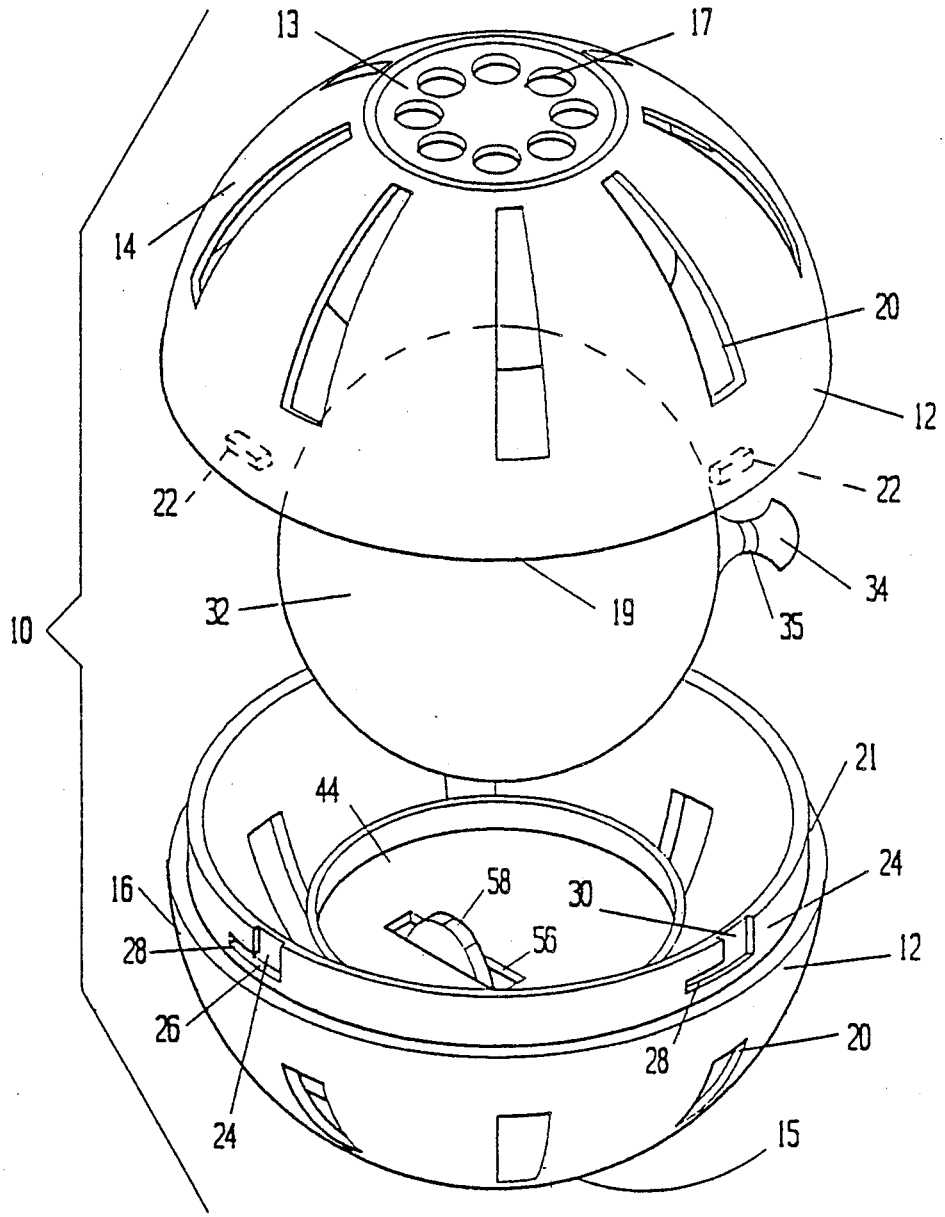
FIG. 1 is an exploded perspective view of the ball.

Referring now to FIG. 1, the invention comprises a ball 10 including an outer foraminous shell 12 that is preferably having two hemispherical half shells 14 and 16, each of which has a plurality of through apertures in the form of elongated slots 20 at equally spaced angular increments about their circumference. Opposite ends of 13 and 15 the assembled shell are flatted, and the flat of the upper hemispherical half shell 14 is perforated with a plurality of circular aperture 17. The two hemispherical half shells are received together at their circular bases 19 and 21 which are on the equator of the spherical ball 10. Suitable means are provided to retain the assembly of the two half shells 14 and 16. Various assembly means can be used, including threaded engagement or an interlocking slot and key engagement. The latter is preferred and is illustrated with one hemispherical half shell 14 bearing a plurality of raised keys 22 spaced about its inner wall which coact with mating offset grooves 24 that are spaced about the upstanding inner cylindrical wall 26 of the opposite hemispherical half shell 16. Each offset groove 24 has a long base slot 28 and a shorter entrance slot 30, thereby permitting an interlocking assembly and disassembly of the hemispherical half shells. Centrally disposed within the outer shell 12 formed by assembly of the hemispherical half shells is a balloon 32 formed of a thin membrane, preferably of plastic, and most preferably of an elastomer. An example of a suitable balloon is a rubber latex balloon. The balloon 32 forms an interior closure within the outer shell 12, and this enclosure has a port, open end 34, which can be used for filling the balloon and then can be sealed with a tie 35 in a customary manner.

Referring now to FIG. 2, there is shown an elevational sectional view of the ball. As previously mentioned, the two half shells 14 and 16 are aligned and assembled together at their bases and half shell 16 has a cylindrical wall 26 that is received within the other hemispherical half shell 14. The upper half shell 14 has a cylindrical inner wall 23 which presses against balloon 32 and stabilizes the balloon (see FIG. 1) within the assembled shell. Received within half shell 16 is a timer and release subassembly 36 which has a subassembly housing 40 forming an interior chamber 42 which is covered by a support platform 44 which faces inwardly of the assembled outer shell 12. The platform 44 serves to support the balloon 32. Received within the housing of the timer and release mechanism is a spring-driven motor 48, which has a winding shaft 50 with a key, disc 46, to wind the spring of the motor. The drive motor 48 has an output shaft 52 which extends from the subassembly housing 40 and which supports cam 54 which has a single lobe 58.

The timer and release mechanism is also illustrated in FIGS. 3 and 4. As shown in FIG. 3, the platform 44 has an aperture 56, in the form of a slot which receives cam 54 so that the single lobe 58 of the cam extends through the slot as the cam is rotated.

Referring now FIG. 4, the motor and release subassembly is inverted from its position in FIG. 3, showing the circular winding disc 46 which preferably has a single raised rib 60 which aids gripping of the disc 46.

As apparent from FIG. 3, the cam is mounted adjacent the slot 56 so that its single lobe 58 will extend through the slot 56 and above the platform 44. The release means is a membrane rupturing member which comprises an abrasive layer 62 on the lobe 58 of the cam 54. Suitable abrasive layers include coatings of abrasives, e.g., a coating of sandpaper or alumina grit. As the cam is rotated, this abrasive layer 62 will rub against the membrane of balloon 32, tearing the membrane and thus rupturing the balloon to release its contents.

Referring now to FIG. 5, there is illustrated an alternative embodiment of the invention. The outer shell 10 and the inner membrane container (not shown), are the same as previously described with reference to FIGS. 1 and 2. The timer and release mechanism 36 are also contained in a subassembly housing 40 and the motor 48 has a winding disc 46, all as previously described. In this embodiment, however, the release mechanism includes a pin member 64 which is slidably received in a cylindrical well 66 which depends from the underside 68 of the platform 44. The platform 44 has a single central aperture 70 (see FIG. 6) through which the pin 72 of the pin member 64 can extend. The pin member 64 rides on the surface of the cam 55 and is biased against the cam 55 by a coil spring 74 which is received over the pin member 64. The pin member 64 is thus biased into a retracted position and is moved into its extended position shown in FIG. 6 by the cam 55 with its single lobe 57.

Preferably a safety interlock is provided to prevent the pin 72 from extending through the aperture 70 when the two hemispherical half shells are disassembled. As shown in FIGS. 5 and 7, a slide member 76 is positioned in the base slot 28 of one of the grooves 24 so that it is forced downwardly when the mating key 22 of the other half shell enters the base slot. The lower end 75 of the slide member 76 rests on lever 77 which is pivotally mounted by pin 70, and is spring biased against the downward movement of slide member 76 by a compression spring 81. The opposite end of lever 77 extends through a window 83 in the side wall of the motor housing and engages a drive gear 85 of the motor, thus locking the motor and cam 55 against rotation. When the two halves of the outer shell 10 are assembled, slide member 76 depresses lever 77 and releases gear 85, permitting rotation of cam 55.

Figure 8:
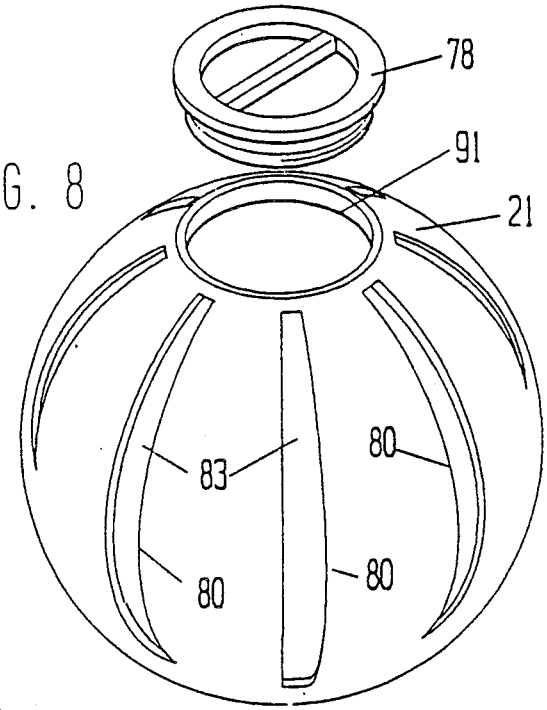
FIG. 8 is a perspective view of an alternative toy of the invention.
Figure 9:
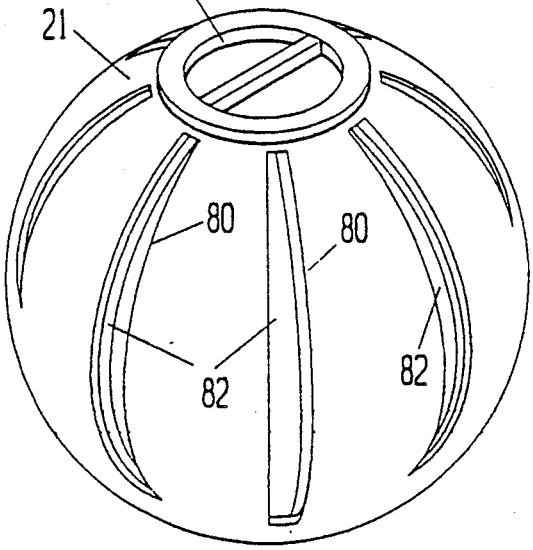
FIG. 9 is a perspective view of the assembled toy of FIG. 8.
Figure 10:
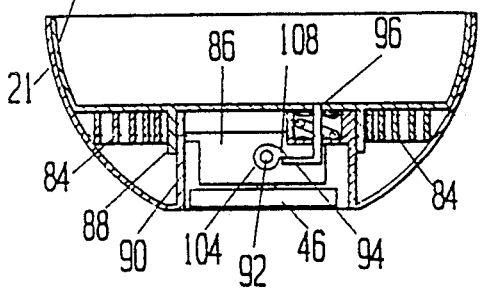
FIG. 10 is an elevational sectional view of the timer and water release mechanism of the toy of FIGS. 8 and 9.

Referring now to FIGS. 8–10, there is illustrated an alternative embodiment. In this embodiment, the outer shell 21 is a single piece member having a port 91 at one end that receives a closure member 78. The shell 21 is foraminous and has a plurality of slots 80 spaced about its circumference. Rotatably received within the outer shell 21 is a second inner spherical member 83 which also has a plurality of slots 82 (see FIG. 9) which can be rotated between a closed position with its wall between slots 82 closing the slots 80 of the outer member as shown in FIG. 8, and an opened position in which its slots are rotated into alignment with the slots of the outer shell, as shown in FIG. 9.

As shown in FIG. 10, the inner member 83 has a cylindrical base 88 at one end which is received about a cylindrical well 90 of the outer shell 21, thereby providing a trunnion that rotationally supports the inner member 83. Preferably, the inner member 83 is spring biased into the position where its slots 82 are aligned with the slots 80 of the outer shell 11. As shown in FIG. 10 this bias can be provided by a helical coil spring 84 which is mounted about the cylindrical base 88 of the inner member and is secured to the outer spherical shell 21.

A timer mechanism 86, which is substantially the same as that previously described is received within the cylindrical well 90 of the outer shell 21. This timer mechanism 86 has an output shaft 92 on which is mounted a cam 104 having a single lobe 108. The lobe 108 of the cam 104 engages a hook shaped latch member 94 that protrudes through the upper wall of the housing and into a single aligned recess 96 in the bottom wall 98 of the inner member 83. This recess extends partially into, but not through the bottom wall.

In this embodiment, the inner member 83 is rotated into a closed position shown in FIG. 8 and the latch member 94 is engaged in the recess 96 in the undersurface of bottom wall of the inner member. The interior of the inner member can then be filled with water and the closure 78 is placed on the inner member and threaded into the upper neck of the inner member. As previously mentioned, the outer member receives the closure and has a sufficiently large aperture to permit the closure to be rotated within the outer shell.

The toy ball is used in the same manner as those previously described. The spring drive of the motor is wound and the motor is released to begin the rotation of the cam, thereby commencing the timed release of the contents of the ball. When the cam rotates into engagement with the latch member and retracts the latch member from its detenting position in the recess, the inner member is released and, under the tension of the spring, will rotate into the water releasing position shown in FIG. 9.

The game comprises two or more participants, preferably several, to play catch with the toy ball. The objective of the game is avoid getting wet when the timing mechanism releases within the inner chamber and ruptures the inner member to release the water. As the timer winds down the ball is thrown between players who must catch the ball to avoid being disqualified. When a player catches the ball or is holding the ball and the inner member is ruptured, the water will discharge, wetting the player who is then disqualified from the game. A water soluble dye can also be dissolved in the water which is used to fill the balloon.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A method of playing a game for at least two players, including a ball, having a chamber defined by a rigid, foraminous wall totally enclosing an interior chamber and totally free of any external appendages, and a timer controlled release mechanism operative to open and discharge the contents of an inner member that forms an interior closure within said interior chamber, said game comprising the steps practiced by said players of:

a. loading water within said inner member;

b. setting said timer to a time interval to actuated said release mechanism upon expiration of said time interval; and c. throwing said ball to at least one of said players and catching said ball, with the objective for said players being avoid being wetted with water from the interior chamber of the ball while catching, holding or throwing the ball at the moment that said timer actuates said release mechanism.

2. The method of claim 1 in which any one of said players is disqualified and must withdraw from the play when the ball releases water onto said any one of said players.

3. The method of claim 2 wherein another one of said players is disqualified when said another player fails to catch the ball.

4. The method of claim 1 in which a water soluble dye is dissolved in the water.

5. A toy comprising a container with a rigid, foraminous wall totally free of any external appendages, and totally enclosing an interior chamber, an enclosure totally received within said interior chamber and filled with water and having opening means at a wall surface location, a wall opening means with a timer mechanism also contained within said interior chamber and positioned in operative engagement therein to activate said wall opening means, and including randomly selectable time setting means whereby the duration of time interval between setting of said time setting means and activation of said wall opening can be preset.

6. The toy of claim 5 wherein said enclosure is formed of a frangible wall element adjacent said location, and said wall opening means comprises frangible wall rupturing means operative to rupture said frangible wall element.

7. The toy of claim 6 wherein said container is a ball.

8. The toy of claim 7 wherein said timer mechanism is a motor driven rotary means having a cam surface which is operative to urge said rupturing means through said frangible wall.

9. The toy of claim 8 wherein said frangible wall enclosure is an elastic toy balloon.

10. The toy of claim 9 wherein said frangible wall rupturing means is a pin member positioned to ride on said can, and including spring means biasing said pin out of engagement with said toy balloon.

11. The toy of claim 9 wherein said frangible wall rupturing means comprises abrasive means carried on said cam surface and operative to abrade the surface of said toy balloon.

12. The toy of claim 5 wherein said toy comprises a first, outer container and a second inner container rotationally received within said first container, with each of said first and second containers having openings located in the respective walls thereof which, upon rotation of said second, inner container, move into and out of alignment including a resilient spring biased to rotate said second, inner container into a position with its wall openings aligned with the wall openings of said first, outer container, and including detent means locking said inner container in a position with its wall openings out of alignment with the wall openings of said first, outer container.

13. The toy of claim 12 wherein said timer mechanism comprises a motor driven rotary means having a cam surface which is operative to move said detent means out of its locking position, releasing said second, inner container for rotation.

14. The toy of claim 13 wherein said first container is generally spherical, with an internal wall having a central aperture, and said second container has a flat bottom wall resting on said internal wall with a trunion projecting into said central aperture, thereby providing rotational support for said second container.

* * * * *

UNITED STATES PATENT AND TRADEMARK OFFICE

CERTIFICATE OF CORRECTION

PATENT NO. : 4,991,847

DATED : February 12, 1991

INVENTOR(S) : Elliot Rudell et al

It is certified that error appears in the above-identified patent and that said Letters Patent is hereby corrected as shown below:

On the title page, item [21]:
The application serial no. should be corrected to read 435,593

In the claims:

Claim 10, column 6, line 10, delete "can" and insert therefor --cam--.

Signed and Sealed this

Ninth Day of June, 1992

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 4,991,847
DATED : February 12, 1991
INVENTOR(S) : Elliot Ruddell et al.

It is certified that error appears in the above-identified patent and that said Letters Patent is hereby corrected as shown below:

Title page,
Item [21], in the Appl. No., replace "433,593" with -- 435,593 --.

Signed and Sealed this

Eleventh Day of June, 2002

*Attest:*

*Attesting Officer*

JAMES E. ROGAN
*Director of the United States Patent and Trademark Office*